US011737613B2

(12) United States Patent
Scoular

(10) Patent No.: US 11,737,613 B2
(45) Date of Patent: Aug. 29, 2023

(54) TOILET PAPER HOLDER

(71) Applicant: Sheila Scoular, Madeira Park (CA)

(72) Inventor: Sheila Scoular, Madeira Park (CA)

( * ) Notice: Subject to any disclaimer, the term of this patent is extended or adjusted under 35 U.S.C. 154(b) by 187 days.

(21) Appl. No.: 17/471,718

(22) Filed: Sep. 10, 2021

(65) Prior Publication Data

US 2022/0079393 A1 Mar. 17, 2022

Related U.S. Application Data

(60) Provisional application No. 63/077,730, filed on Sep. 14, 2020.

(51) Int. Cl.
*A47K 10/22* (2006.01)

(52) U.S. Cl.
CPC ..... *A47K 10/22* (2013.01)

(58) Field of Classification Search
CPC ..... A47K 10/22; A47K 10/16; A47K 10/10; A47K 10/18; A47K 10/20; A47K 10/12; A47K 10/025; A47K 10/04; A47K 10/00; D06F 57/12; A47F 5/0006; B65D 85/672; E05B 73/0005
USPC ..... 206/225, 391, 392; 211/31, 86.01, 211/119.009, 49.1
See application file for complete search history.

(56) References Cited

U.S. PATENT DOCUMENTS

| | | | | |
|---|---|---|---|---|
| 1,700,265 | A * | 1/1929 | Kissam | A47K 10/22 206/394 |
| 4,273,392 | A * | 6/1981 | Stinson | A47K 10/22 206/394 |
| 6,854,596 | B1 * | 2/2005 | Wiese | A47K 10/22 206/394 |
| 6,957,791 | B2 * | 10/2005 | Ellis | A47K 10/22 242/561 |
| 11,261,623 | B1 * | 3/2022 | Giles | B65D 83/08 |
| 2005/0126942 | A1 * | 6/2005 | McAndrew | A47K 10/22 206/349 |
| 2008/0073243 | A1 * | 3/2008 | Rosh | A47K 10/22 206/581 |
| 2011/0168581 | A1 * | 7/2011 | Williams | A47K 10/22 206/216 |
| 2013/0264411 | A1 * | 10/2013 | Thati | A47K 10/22 242/594.3 |
| 2022/0338684 | A1 * | 10/2022 | Ndakaziva | A47K 10/22 |

* cited by examiner

*Primary Examiner* — Rafael A Ortiz
(74) *Attorney, Agent, or Firm* — Brennan, Manna & Diamond, LLC

(57) ABSTRACT

The present invention relates to a toilet paper holder device that can be used to store toilet paper rolls vertically within a bathroom or other room in a manner that saves space. The device is primarily comprised of a base member, a hanging line, an end piece and an outer covering. The base member allows the device to be attached to a ceiling, wherein the line can be attached to the base member. Toilet paper rolls can then be stored vertically upon the line, wherein the line runs through each cardboard core of a toilet paper roll. To keep the rolls secured on the line, the device also comprises an end piece. In addition, the device comprises an outer covering that conceals the line and toilet paper rolls.

20 Claims, 3 Drawing Sheets

TOILET PAPER HOLDER

CROSS-REFERENCE TO RELATED APPLICATION

The present application claims priority to, and the benefit of, U.S. Provisional Application No. 63/077,730, which was filed on Sep. 14, 2020 and is incorporated herein by reference in its entirety.

FIELD OF THE INVENTION

The present invention relates generally to the field of toilet paper holders. More specifically, the present invention relates to a toilet paper holder device that can be used to store toilet paper rolls vertically within a bathroom or other room in a manner that saves space. The device is comprised of a base member, a hanging line, an end piece and an outer covering. The base member allows the device to be attached to a ceiling, wherein the hanging line can be attached to the base member. Toilet paper rolls can then be stored vertically upon the line, wherein the line runs through each cardboard core of a toilet paper roll. To keep the rolls secured on the line, the device also comprises an end piece. In addition, the device is comprised of an optional outer covering that conceals the line and toilet paper rolls from view. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Typically, users store multiple rolls of toilet paper in their home. Within a home, toilet paper is most commonly stored in a bathroom cabinet. However, some bathroom cabinets lack the space to store multiple toilet paper rolls and as a result toilet paper rolls must be stored in separate rooms, cabinets or closets outside of the bathroom. Therefore, a user may forget to bring a new toilet paper roll into the bathroom and be stuck without toilet paper after using the bathroom. To combat this problem, users may stack multiple toilet paper rolls within their bathroom. However, this is undesirable and unsightly.

Therefore, there exists a long-felt need in the art for an improved toilet paper holding device. There also exists a long-felt need in the art for a toilet paper holder device that can store a plurality of toilet paper rolls and therefore eliminate the need for a user to store multiple rolls within a cabinet or at a secondary location. Further, there exists a long-felt need in the art for a toilet paper holding device that takes up minimal space, yet still offers a convenient and easily accessible way to access the toilet paper. Finally, there exists a long-felt need in the art for a toilet paper holder that is visually appealing and conceals toilet paper rolls out of sight, while still allowing easy access to said rolls.

The subject matter disclosed and claimed herein, in one embodiment thereof, comprises a toilet paper holder device that can be used to store toilet paper rolls vertically within a bathroom or other room in a manner that saves space. The device is comprised of a base member, a hanging line, an end piece and an outer covering. The base member allows the device to be secured to a ceiling, wherein the hanging line can be attached to the base member. Toilet paper rolls can then be stored vertically upon the line, wherein the line runs through each cardboard core of a toilet paper roll. To keep the rolls secured on the line, the device is also comprised of an end piece. In addition, the device is comprised of an outer covering that conceals the line and toilet paper rolls from view.

In this manner, the toilet paper holder device of the present invention accomplishes all of the forgoing objectives and provides an improved means to store toilet paper within a bathroom. The device can also be placed in a small area that would otherwise be unusable within a bathroom, yet still allows a user to store a plurality of toilet rolls in a vertical manner wherein the rolls remain easily accessible. In addition, the outer covering of the device is visually appealing and conceals toilet paper rolls out of sight, while still allowing said rolls to be easily accessed within the same room as a toilet.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a toilet paper holder device. The device can be used to store toilet paper rolls vertically within a bathroom or other room in a manner that saves space. The device comprises a base member, a hanging line, an end piece and an outer covering. The base member allows the device to be attached to a ceiling or other flat surface via an attachment structure such as an adhesive surface with a peeling backing, at least one suction cup or any traditional fastener known in the art. The bottom surface of the base member may also be comprised of an attachment structure in the form of a fixedly or removably-attached hook or other structure. Said attachment structure then receives a hanging line that is hung from the structure, wherein toilet paper rolls can be hung from the line.

The line also comprises an end piece that is removably or fixedly-secured to the line at the farthest point of the line from the attachment structure of the base member. The end piece has a height dimension that is smaller than the diameter of a cardboard core of a toilet paper roll, and a width that is larger than the diameter of a cardboard core of a toilet paper roll. Thus, when toilet paper rolls are hung on the line, the end piece is positioned parallel to the bottom surface of the base member. However, the end piece can be turned perpendicular to the bottom surface such that the core of a toilet paper roll can be slid over the end piece and retained on the line. Then, once the desired amount of toilet paper rolls have been placed on the line, the end piece can again be orientated parallel to the bottom surface to store the rolls in a vertically stacked fashion atop one another. A user can also orient the end piece perpendicular to the bottom surface of the base member to remove rolls as needed and return the end piece to a position parallel to the bottom surface once a roll has been removed.

Furthermore, the device may include an outer covering that hides the line and any toilet paper rolls on the line from view. The covering may be opaque, transparent, or semi-transparent in differing embodiments, and have any number of indicia that can include but is not limited to any number of patterns, designs, logos, words, colors, images, symbols, photos, characters, animals, figures, etc. Further, a transparent version of the outer covering may be double-layered such that a user can insert their own material in between the layers to give the covering their own unique design or appearance. In addition, the device may come with a plurality of outer coverings wherein each covering has a differing appearance, and a user can mix and match and change the outer coverings depending on their needs and/or wants.

Accordingly, the improved toilet paper holder device of the present invention is particularly advantageous as it allows user to store multiple toilet paper rolls in a manner that does not take up significant space that could otherwise be used in a bathroom. As a result, the device eliminates the need for a user to store multiple rolls within a cabinet or at a secondary location. Further the device takes up minimal space yet still allows toilet paper rolls to be easily accessible. Finally, the device is visually appealing and conceals toilet paper rolls out of sight, while still allowing said rolls to be easily accessed.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
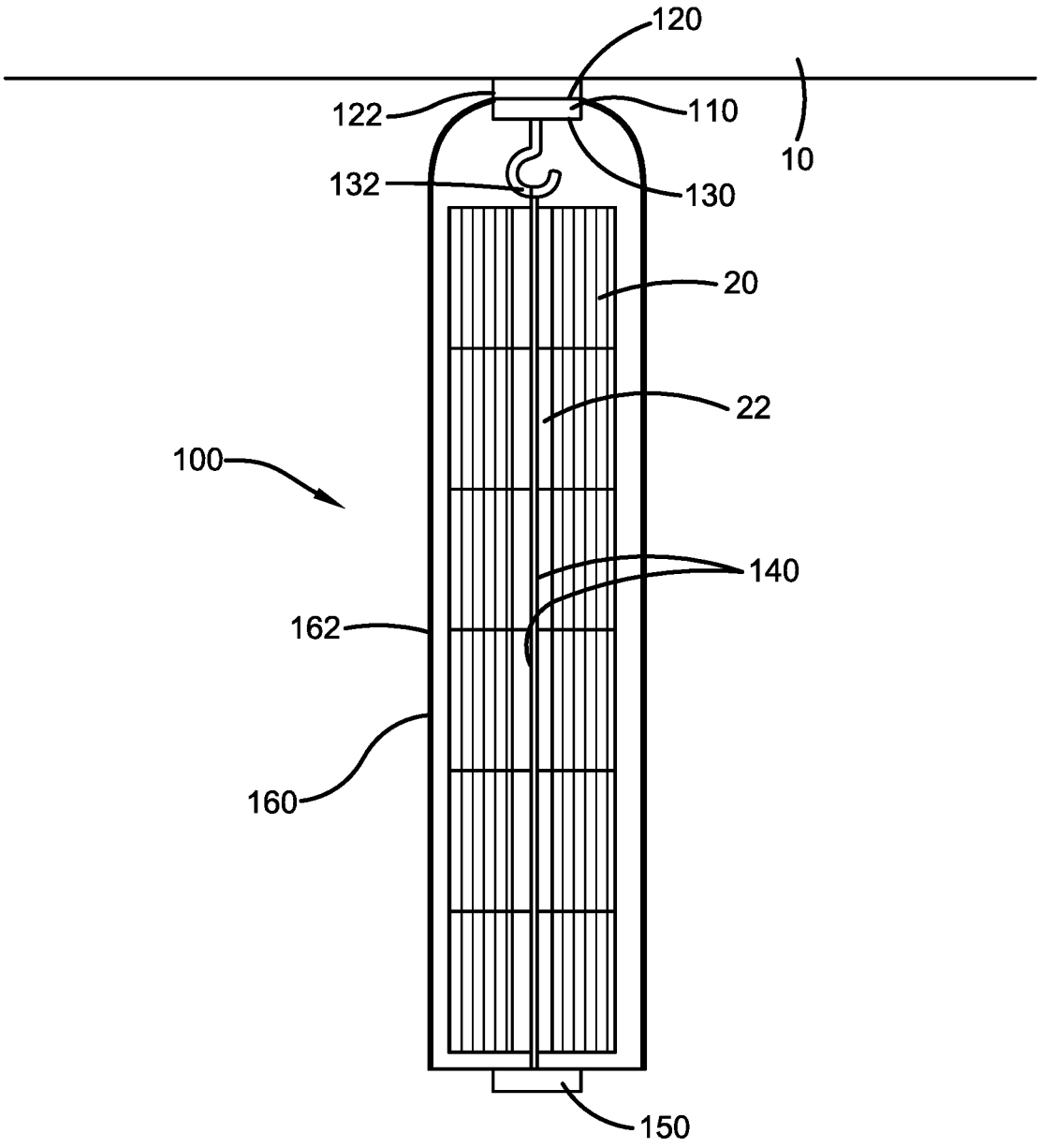
FIG. 1 illustrates a cross-sectional view of one potential embodiment of a toilet paper holder device of the present invention hanging from a celling in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved toilet paper holding device. There also exists a long-felt need in the art for a toilet paper holder device that can store a plurality of toilet paper rolls, and therefore eliminates the need for a user to store multiple rolls within a cabinet or at a secondary location. Further, there exists a long-felt need in the art for a toilet paper holding device that takes up minimal space, yet still offers a convenient and easily accessible way to access the toilet paper. Finally, there exists a long-felt need in the art for a toilet paper holder device that is visually appealing and conceals toilet paper rolls out of sight, while still allowing said rolls to be easily accessed.

The present invention, in one exemplary embodiment, is a toilet paper holder device. The device can be used to store toilet paper rolls vertically within a bathroom or other room in a manner that saves space. The toilet paper holder device comprises a base member, a hanging line, an end piece and an outer covering. The base member allows the device to be attached to a ceiling or other flat surface via an attachment structure such as an adhesive surface with a peeling backing, at least one suction cup, or any traditional fastener known in the art. In addition, the bottom surface of the base member may also be comprised of an attachment structure in the form of a fixedly or removably attached hook or other structure, wherein the attachment structure then receives a hanging line that is hung from the structure. The line then receives toilet paper rolls which can be hung and stored on the line.

Further, the line has a removably or fixedly-secured end piece attached to the line at the farthest point from the attachment structure of the base member, wherein the end piece has a height dimension that is smaller than the diameter of a cardboard core of a toilet paper roll and a width that is larger than the diameter of a cardboard core of a toilet paper roll. Accordingly, when toilet paper rolls are hung on the line, the end piece is positioned parallel to the bottom surface of the base member. However, the end piece can be turned perpendicular to the bottom surface such that the core of a toilet paper roll can be slid over the end piece and retained on the line. Once the desired amount of toilet paper rolls have been placed on the line, the end piece can again be orientated parallel to the bottom surface to store the rolls on the line in a vertically stacked fashion atop one another. Likewise, a user can also orient the end piece perpendicular to the bottom surface to remove rolls as needed, and return the end piece to a position parallel to the bottom surface once a roll has been removed.

The device may also include an outer covering that conceals the line and any toilet paper rolls on the line from view when the device is hung within a bathroom. The outer covering may be opaque, transparent or semi-transparent in differing embodiments and have any number of indicia that can include but is not limited to any number of patterns, designs, logos, words, colors, images, symbols, photos, characters, animals, figures, etc. A transparent version of the outer covering may also be double-layered, such that a user can insert their own material in between the layers to give the covering their own appearance and/or design. Furthermore, the device may come with a plurality of outer coverings wherein each covering has a differing appearance and/or design to be mixed and matched depending on a user's needs and/or wants.

Accordingly, the improved toilet paper holder device of the present invention is particularly advantageous as it allows user to store multiple toilet paper rolls in a manner that does not take up space that would otherwise be used within a bathroom. Therefore, the device eliminates the need for a user to store multiple rolls within a cabinet or at a secondary location and saves space. However, the device still allows toilet paper rolls to be easily accessible and is visually appealing, while concealing toilet paper rolls out of sight.

Referring initially to the drawings, FIG. 1 illustrates a cross-sectional view of one embodiment of a toilet paper holder device 100 of the present invention hanging from a ceiling 10. The device 100 is comprised of a base member 110 that attaches to a ceiling 10, a hanging line 140, an end piece 150, and an outer covering 160. The device 100 preferably can be attached via the base member 110 to a ceiling 10 within a bathroom or other room, but it should be appreciated that the device 100 may be attached to any suitable surface such as but not limited to walls or other items or surfaces within a room or bathroom as is known in the art. The base member 110 is preferably comprised of a stainless-steel or other metal material or durable plastic material, such as but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc., or any other suitable material as is known in the art. Further, the base member 110 may be any suitable shape known in the art in differing embodiments, including but not limited to: circular, oblong, square, rectangle, triangular, trapezoidal, etc.

Figure 2:
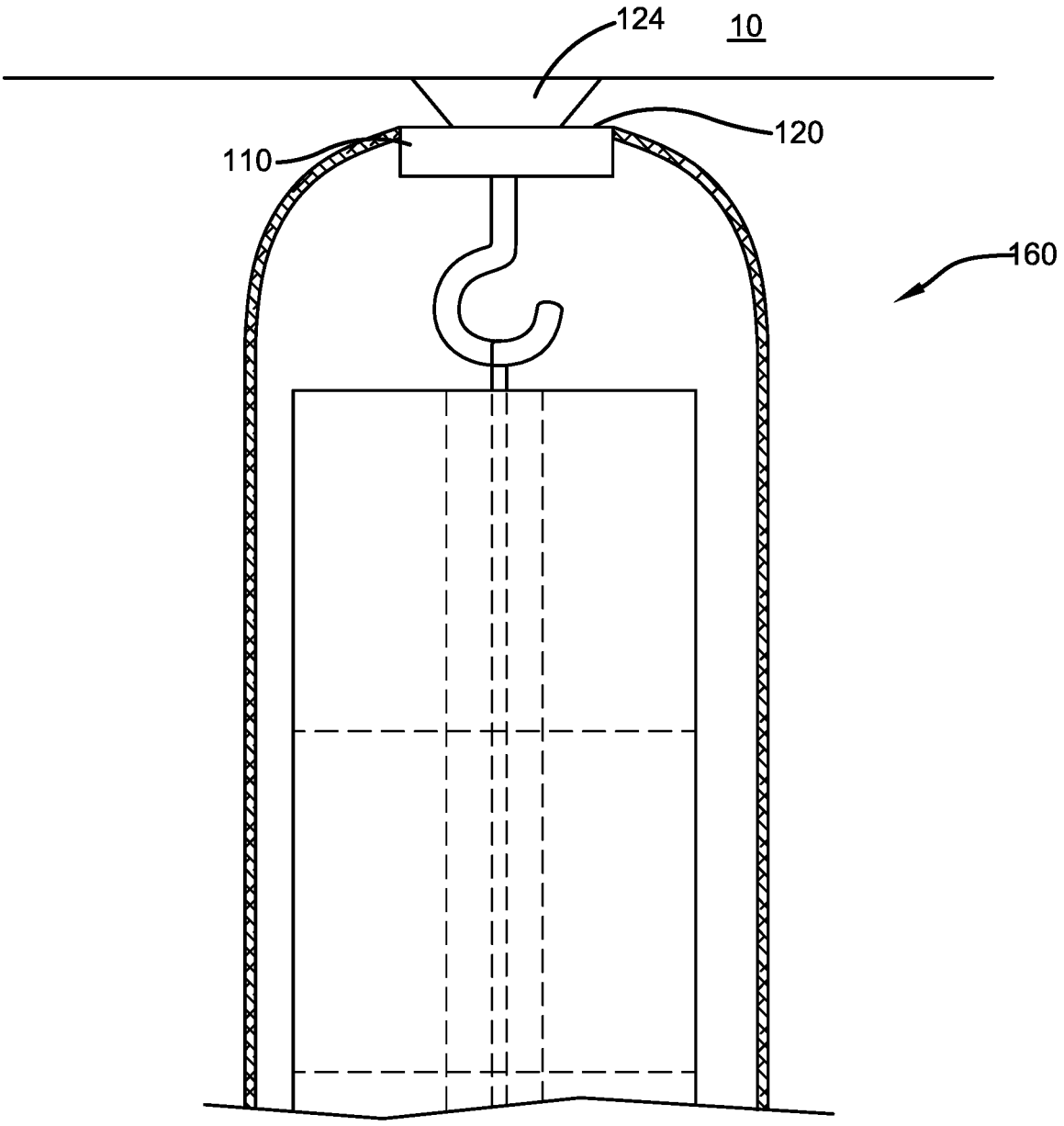
FIG. 2 illustrates an enlarged cross-sectional view of one potential embodiment of a toilet paper holder device of the present invention hanging from a celling in accordance with the disclosed architecture.

In differing embodiments, the top surface 120 of the base member 110 may also be comprised of a plurality of top attachment structures that allow the base member 110 to attach to a ceiling 10 or other uneven surface as is known in the art. Said structures may include but are not limited to an adhesive layer 122 with a peelable backing or at least one suction cup 124 (as shown in FIG. 2), etc., or any other suitable top attachment structures as is known in the art. In addition, the base member 110 may be attached to a ceiling 10 or other surface via traditional fasteners such as nails, screws, bolts, etc., or any other suitable fastener as is known in the art. In this manner, the device 100 can be placed within an otherwise small and unusable area of a bathroom or room, wherein any other structure or storage device could not be used due to space constraints. The bottom surface 130 of the base member 110 is further comprised of a bottom attachment structure 132 that in one embodiment may be in the form of a hook, that may be fixedly (i.e. molded) or removably-secured (i.e. via fasteners) to the base member 110. In other embodiments, the bottom attachment structure 132 may be in the form of a magnet, an adhesive surface, a hook and loop surface, etc., or any other suitable fastener structure as is known in the art.

The bottom attachment structure 132 then receives a continuously looped line (or hanging line) 140 that is hung from the structure 132, wherein the cardboard core 22 of a toilet paper roll 20 can be fed through the hanging line 140 such that multiple rolls 20 can be stacked on top of one another in a vertical fashion. In differing embodiments, the line 140 may be comprised of a plurality of durable rope materials such as but not limited to: manila hemp, hemp, linen, cotton, coir, jute, straw, sisal, polypropylene, nylon, polyesters (i.e. PET, LCP, Vectran), polyethylene (i.e. Dyneema and Spectra), aramids (i.e. Twaron, Technora and Kevlar) and acrylics (i.e. Dralon), etc., or any combination thereof, or any other suitable rope material as is known in the art. In a further embodiment, the line 140 may have the appearance of a metallic (i.e. gold, silver, or bronze, etc.) chain. It is also contemplated that the line 140 may be of any suitable length, as long as it can store at least one toilet paper roll 20, and can be manufactured or cut to length by the user based on their needs and/or wants.

The line 140 is further comprised of an end piece 150 that may be fixedly or removably-secured to the line 140 at an end portion of the line 140, farthest from the bottom attachment structure 132. In differing embodiments, the end piece 150 may be flat or a three-dimensional shaped structure, and may be tubular, rectangular, etc., or any other suitable shape as is known in the art. The end piece 150 may also comprise any number of colors, designs, patterns, and finishes, etc., in addition to ornamental elements 156 (shown in FIG. 3) in the form of a plurality of faux crystals or gemstones, etc., or any other suitable designs or ornaments as are known in the art.

FIG. 2 illustrates an enlarged view of one embodiment of a toilet paper holder device 100 of the present invention. The top surface 120 of the base member 110 comprises an attachment structure that allows the base member 110 to attach to a ceiling 10 or other surface. In this embodiment, the structure is at least one suction cup 124 which removably secures to the ceiling 10, allowing a user to position the device 100 on the ceiling and then move the device 100 when needed. In addition, the bottom surface 130 of the base member 110 is further comprised of a bottom attachment structure 132 that may be fixedly or removably-secured to the base member 110. The bottom attachment structure 132 receives a continuously looped line 140 that is hung from the structure 132, wherein the cardboard core 22 of a toilet paper roll 20 can be fed through the line 140 such that multiple rolls 20 can be stacked on top of one another in a vertical fashion. Further, to conceal toilet paper rolls 20 stored on the line 140 from view, the device 100 may also comprise an outer covering 160. The outer covering 160 may be removably or fixedly-secured to the base member 110, and may comprise a variety of designs and/or patterns based on a user's wants and/or needs.

Figure 3:
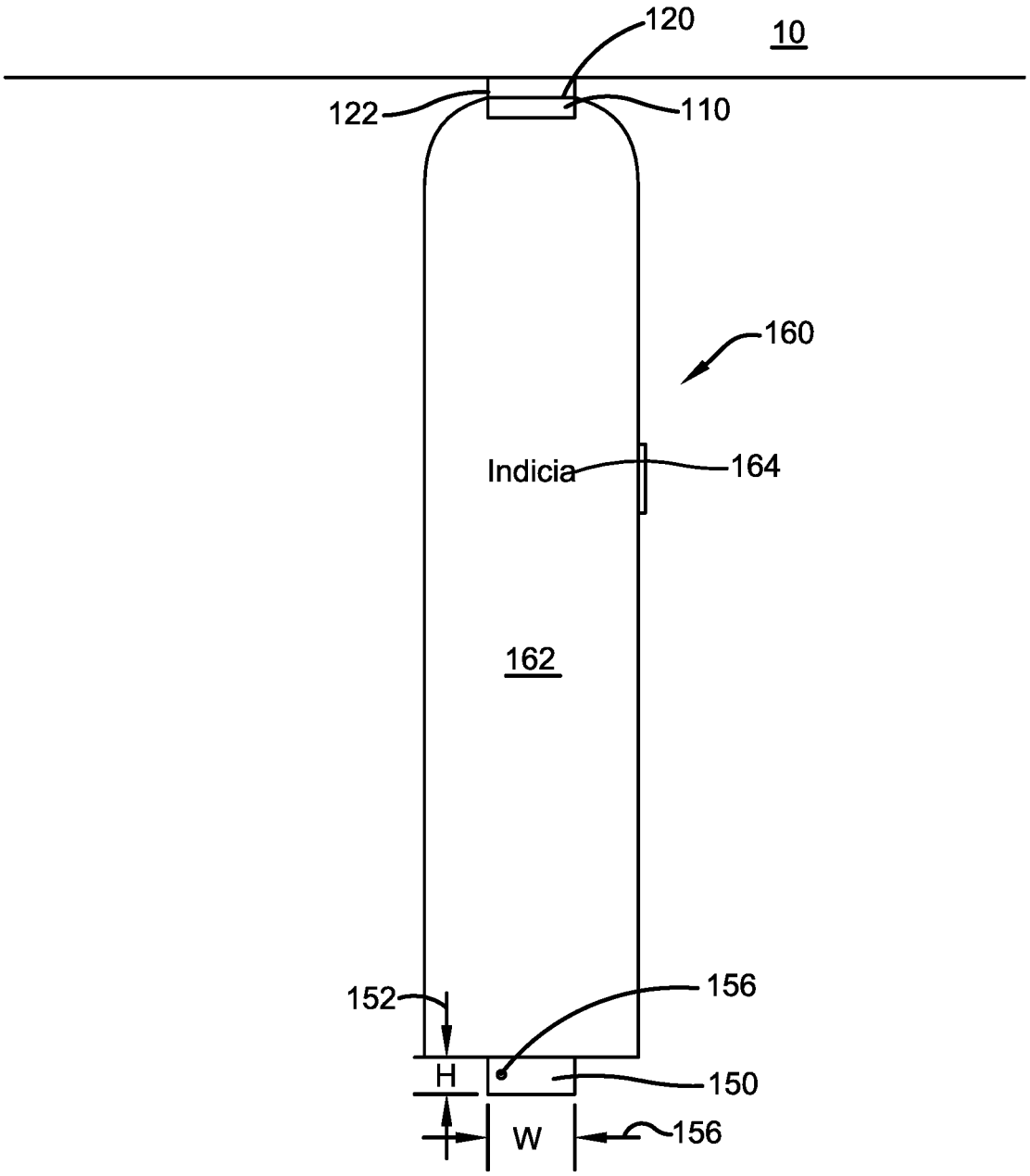
FIG. 3 illustrates a perspective view of one potential embodiment of a toilet paper holder device of the present invention including the outer covering in accordance with the disclosed architecture.

FIG. 3 illustrates a perspective view of one embodiment of a toilet paper holder device 100 of the present invention comprising the outer covering 160. To conceal toilet paper rolls 20 stored on the line 140 from view, the device 100 may also comprise an outer covering 160. The outer covering 160 may be removably or fixedly-secured to the base member 110 via adhesive, hook and loop fasteners, or snaps, etc., or any other suitable securing means as is known in the art. The outer covering is preferably comprised of a material such as but not limited to: vinyl, microfiber, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, metal (e.g., aluminum) etc., or any other suitable material as is known in the art. In differing embodiments, the material of the outer covering 160 may be opaque, transparent or semi-transparent. In addition, the material of the outer covering 160 may be transparent and double-layered such that a user can insert their own material in between the layers to give the covering their own appearance and design. In this manner, the outer covering 160 hides any toilet paper rolls 20 and the line 140 from view to make the device 100 more aesthetically appealing.

The outer surface 162 of the outer covering 160 may further be comprised of any number of indicia 164 which can include, but is not limited to any number of patterns, designs, logos, words, colors, images, symbols, photos, characters, animals, figures, etc., or any other suitable designs or patterns as is known in the art. In addition, the device 100 may be comprised of a plurality of outer coverings 160 that differ in appearance and design to provide a user with a variety of outer covering 160 options, which allows a user to mix and match the outer coverings 160 based on their needs and/or wants.

Additionally, the end piece 150 which is fixedly or removably-secured to an end portion of the line 140, farthest from the bottom attachment structure 132, may be cylindrical, tubular, rectangular, etc., or any other suitable shape as is known in the art. The end piece 150 may also comprise any number of colors, designs, patterns, and finishes, etc., in addition to ornamental elements 156 in the form of a plurality of faux crystals or gemstones, etc., or any other suitable designs or ornaments as is known in the art.

The height 152 of the end piece 150 is preferably slightly smaller than the diameter of a cardboard core 22 of a conventional toilet paper roll 20. In addition, the width 154 of the end piece 150 is preferably larger than the diameter of a cardboard core 22 of a conventional toilet paper roll 20. Accordingly, when toilet paper rolls 20 are stored on the line 140, the end piece 150 is positioned parallel to the bottom surface 130 of the base member 110 to retain the toilet paper rolls 20 on the line. However, in order to insert a toilet paper roll 20 on the line 140, the end piece 150 can be turned perpendicular to the bottom surface 130 via a simple pivot, wherein the core 22 of a toilet paper roll 20 can then be slid over the end piece 150 and onto the line 140. Then, once the desired amount of toilet paper rolls 20 have been placed on the line 140, the end piece 150 can again be orientated parallel to the bottom surface 130 to retain the rolls 20 on the line 140 in a vertically stacked fashion on top of one another. Similarly, a user can orient the end piece 150 perpendicular to the bottom surface 130 to remove toilet paper rolls 20 as needed, and return the end piece 150 to a position parallel to the bottom surface 130 once a toilet paper roll 20 has been removed.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "toilet paper holder device", "toilet paper holder", and "device" are interchangeable and refer to the toilet paper holder device 100 of the present invention.

Notwithstanding the forgoing, the toilet paper holder device 100 of the present invention and its various components can be of any suitable size and configuration as is known in the art without affecting the overall concept of the invention, provided that they accomplish the above-stated objectives. One of ordinary skill in the art will appreciate that the size, configuration and material of the toilet paper holder device 100 as shown in FIGS. 1-3 is for illustrative purposes only, and that many other sizes and shapes of the toilet paper holder device 100 are well within the scope of the present disclosure. Although the dimensions of the toilet paper holder device 100 are important design parameters for user convenience, the toilet paper holder device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A toilet paper holder device that allows a plurality of toilet paper rolls to be easily accessible while concealing the plurality of toilet paper rolls from sight, the toilet paper holder device comprising:

a base member comprising a top surface and a bottom surface;

a hanging line secured to the bottom surface of the base member;

an end piece secured to an end of the hanging line;

an outer covering for concealing a toilet paper roll, wherein the hanging line is fed through a cardboard core of the toilet paper roll such that the plurality of toilet paper rolls can be stacked on top of one another in a vertical fashion along the hanging line, and further wherein the top surface of the base member is removably secured to a surface via an adhesive.

2. The toilet paper holder device of claim 1, wherein the base member comprises an attachment structure secured on the bottom surface for retaining the hanging line.

3. The toilet paper holder device of claim 2, wherein the attachment structure is a hook that is fixedly secured to the bottom surface of the base member.

4. The toilet paper holder device of claim 2, wherein the attachment structure is a hook that is removably secured to the bottom surface of the base member.

5. A toilet paper holder device that allows a plurality of toilet paper rolls to be easily accessible while concealing the plurality of toilet paper rolls from sight, the toilet paper holder device comprising:

a base member comprising a top surface and a bottom surface, wherein the top surface is removably secured to a ceiling via a suction cup, and further wherein the bottom surface comprises an attachment structure;

a hanging line secured to the bottom surface of the base member via the attachment structure;

an end piece secured to an end of the hanging line; and an outer covering connected to the base member for concealing a toilet paper roll, wherein the hanging line is fed through a cardboard core of a toilet paper roll such that the plurality of toilet paper rolls can be stacked on top of one another in a vertical fashion along the hanging line.

6. The toilet paper holder device of claim 5, wherein the outer covering is removably secured to the base member.

7. The toilet paper holder device of claim 5, wherein the outer covering is fixedly attached to the base member.

8. A toilet paper holder device that allows a plurality of toilet paper rolls to be easily accessible while concealing the plurality of toilet paper rolls from sight, the toilet paper holder device comprising:

a base member comprising a top surface and a bottom surface, wherein the top surface of the base member is removably secured to a ceiling via a top attachment structure, and further wherein the bottom surface comprises a bottom attachment structure;

a hanging line that is secured to the bottom surface of the base member via the bottom attachment structure and is of such a length to retain at least one toilet paper roll;

an end piece secured to an end of the hanging line; and an outer covering connected to the base member for concealing a toilet paper roll, wherein the hanging line is positioned within a cardboard core of the toilet paper roll such that the plurality of toilet paper rolls can be stacked on top of one another in a vertical fashion along the hanging line.

9. The toilet paper holder device of claim 8, wherein the top attachment structure is comprised of an at least one suction cup.

10. The toilet paper holder device of claim 8, wherein the top attachment structure is comprised of an adhesive layer with a peelable backing.

11. The toilet paper holder device of claim 8, wherein the bottom attachment structure is comprised of a hook, a magnet, an adhesive surface, or a hook and loop surface.

12. The toilet paper holder device of claim 8, wherein the hanging line is a metallic chain.

13. The toilet paper holder device of claim 8, wherein the end piece has a color, a design, a pattern, or a finish.

14. The toilet paper holder device of claim 8, wherein the end piece has an ornamental element in a form of a plurality of faux crystals or a plurality of gemstones.

15. The toilet paper holder device of claim 8, wherein a height of the end piece is smaller than a diameter of the cardboard core of the toilet paper roll.

16. The toilet paper holder device of claim 15, wherein a width of the end piece is larger than a diameter of the cardboard core of the toilet paper roll.

17. The toilet paper holder device of claim 16, wherein the end piece can be turned perpendicular to the bottom surface of the base member and wherein the cardboard core of the toilet paper roll can be slid over the end piece and onto the hanging line.

18. The toilet paper holder device of claim 17, wherein once a plurality of toilet paper rolls has been placed on the hanging line the end piece can be orientated parallel to the bottom surface of the base member to retain the plurality of toilet paper rolls on the hanging line in a vertically stacked fashion on top of one another.

19. The toilet paper holder device of claim 8, wherein the outer covering comprises a plurality of indicia such as a pattern, a design, a logo, a word, a color, an image, a symbol, a photo, a character, an animal, or a figure.

20. The toilet paper holder device of claim 8, wherein an outer material of the outer covering is opaque, transparent, semi-transparent, or comprised of a first layer and a second layer such that a user can insert a material in between the first layer and the second layer.

* * * * *